US010147358B2

(12) United States Patent
Lin et al.

(10) Patent No.: US 10,147,358 B2
(45) **Date of Patent: *Dec. 4, 2018**

(54) DRIVING METHOD FOR DISPLAY PANEL

(71) Applicant: GIANTPLUS TECHNOLOGY CO., LTD, Miaoli County (TW)

(72) Inventors: Yu-Yen Lin, Hsinchu (TW); Hou-Hong Li, Yilan County (TW)

(73) Assignee: GIANTPLUS TECHNOLOGY CO., LTD, Miaoli County (TW)

( * ) Notice: Subject to any disclaimer, the term of this patent is extended or adjusted under 35 U.S.C. 154(b) by 0 days.

This patent is subject to a terminal disclaimer.

(21) Appl. No.: 15/615,789

(22) Filed: Jun. 6, 2017

(65) Prior Publication Data

US 2018/0286312 A1 Oct. 4, 2018

(30) Foreign Application Priority Data

Mar. 29, 2017 (TW) ..... 106110491 A

(51) Int. Cl.
*G09G 3/3258* (2016.01)
*G09G 3/325* (2016.01)

(52) U.S. Cl.
CPC ..... *G09G 3/3258* (2013.01); *G09G 3/325* (2013.01); *G09G 2300/0866* (2013.01)

(58) Field of Classification Search
None
See application file for complete search history.

(56) References Cited

U.S. PATENT DOCUMENTS

2006/0022202 A1 2/2006 Yu et al.
2008/0136983 A1* 6/2008 Huang ..... G09G 3/3659 349/38
2009/0160850 A1 6/2009 Tsou et al.
2010/0265168 A1 10/2010 Neugebauer
2011/0181563 A1 7/2011 Tsou et al.
2012/0154369 A1 6/2012 Yamauchi
(Continued)

FOREIGN PATENT DOCUMENTS

CN 103324362 9/2013
CN 104678272 6/2015
(Continued)

OTHER PUBLICATIONS

Yu-Yen Lin et al, "Display Apparatus and Driving Method of Display Panel Thereof", Unpublished U.S. Appl. No. 15/352,597, filed Nov. 16, 2016.

(Continued)

*Primary Examiner* — Duane N Taylor, Jr.
(74) *Attorney, Agent, or Firm* — JCIPRNET

(57) ABSTRACT

A driving method for a display panel is provided. The display panel includes a plurality of pixel circuits arranged in an array. Each of the pixel circuits respectively includes a first switch and a second switch coupled in series. The driving method includes following steps. A first driving signal is received during an update period through a control terminal of the first switch of each of the pixel circuits, so that the first switch of each of the pixel circuits is continuously turned on during the update period. A second driving signal is sequentially received during the update period through a control terminal of the second switch of each of the pixel circuits.

10 Claims, 10 Drawing Sheets

(56) References Cited

U.S. PATENT DOCUMENTS

| | | | | |
|---|---|---|---|---|
| 2016/0063914 | A1* | 3/2016 | Lee | G09G 3/3648 345/211 |
| 2016/0133213 | A1 | 5/2016 | Fung et al. | |
| 2016/0203762 | A1* | 7/2016 | Kim | G09G 3/3258 345/76 |
| 2017/0140724 | A1 | 5/2017 | Lin et al. | |
| 2017/0221445 | A1* | 8/2017 | Wu | G09G 3/3677 |
| 2017/0352320 | A1 | 12/2017 | Lin et al. | |

FOREIGN PATENT DOCUMENTS

| | | |
|---|---|---|
| TW | 200719295 | 5/2007 |
| TW | 201306016 | 2/2013 |

OTHER PUBLICATIONS

"Office Action of Taiwan Counterpart Application," dated Jun. 7, 2017, p. 1-p. 4.
"Search Report of Europe Counterpart Application", dated Apr. 5, 2018, p. 1-p. 10.

* cited by examiner

DRIVING METHOD FOR DISPLAY PANEL

CROSS-REFERENCE TO RELATED APPLICATION

This application claims the priority benefit of Taiwan application serial no. 106110491, filed on Mar. 29, 2017. The entirety of the above-mentioned patent application is hereby incorporated by reference herein and made a part of this specification.

FIELD OF THE DISCLOSURE

The invention relates to a driving technology, and more particularly, to a driving method for a display panel.

DESCRIPTION OF RELATED ART

The increasing progresses of the display technology bring great conveniences to people's daily lives, in which flat panel displays (FPDs) have become the main stream products due to the characteristics of being light and thin. In various FPDs, liquid crystal displays (LCDs) are widely used because of the advantages of high space utility rate, low power consumption, free of radiation, low electromagnetic interference, and the like.

In response to the requirement for saving power, the refresh rate of display apparatuses in some cases may be reduced to 30 Hz or lower; that is, the pixels of the display panel may not perform the screen refreshing function within a certain period of time. At this time, the gate voltages of the transistors in the pixels may, within this period of time, stay at a certain level. If said gate voltages of the transistors stay at the same level for a long time, the transistors may encounter stress, which deteriorates the display quality of the display panel. Therefore, said issue of stress need be resolved to improve the display quality of the display panel.

SUMMARY OF THE INVENTION

The invention provides a driving method for a display panel, and the driving method is capable of restraining the aging effects of the switch devices in the pixel circuit.

In an embodiment of the invention, a driving method adapted for a display panel is provided. The display panel has a plurality of pixel circuits arranged in an array, and each of the pixel circuits includes at least one first switch and a second switch serially coupled to each other. The driving method includes following steps. A first driving signal is received during an update period through a control terminal of the at least one first switch of each of the pixel circuits, such that the at least one first switch of each of the pixel circuits is continuously turned on during the update period. A second driving signal is sequentially received during the update period through a control terminal of the second switch of each of the pixel circuits.

According to an embodiment of the invention, the driving method further includes a step of periodically receiving a plurality of first pulse signals during a waiting period through the control terminal of the second switch of each of the pixel circuits, wherein the first pulse signals have a first pulse width, and the first pulse signals have a first high-level voltage and a first low-level voltage.

According to an embodiment of the invention, the step of periodically receiving the second driving signal during the update period through the control terminal of the second switch of each of the pixel circuits further includes: adjusting at least one of the first high-level voltage and the first low-level voltage of the first pulse signals.

According to an embodiment of the invention, a first time interval exists between the control terminal of the second switch of each of the pixel circuits during the waiting period, so as to sequentially receive the first pulse signals.

According to an embodiment of the invention, a second time interval exists between the control terminal of the second switch of each of the pixel circuits in odd rows and the control terminal of the second switch of each of the pixel circuits in even rows, so as to alternately receive the first pulse signals.

According to an embodiment of the invention, the control terminal of the second switch of each of the pixel circuits simultaneously receives the first pulse signals during the waiting period.

According to an embodiment of the invention, the driving method further includes following steps. Plural second pulse signals are received during the waiting period through the control terminal of the at least one first switch of each of the pixel circuits, wherein the pixel circuits receive the second pulse signals and the first pulse signals at different times, and a second time interval exists between the time at which the first pulse signals are received by the pixel circuits and the time at which the second pulse signals are received by at least one of the pixel circuits.

According to an embodiment of the invention, the second pulse signals have a second high-level voltage and a second low-level voltage, and the step of receiving the second pulse signals during the waiting period through the control terminal of the at least one first switch of each of the pixel circuits includes: adjusting at least one of the second high-level voltage and the second low-level voltage of the second pulse signals.

According to an embodiment of the invention, the at least one first switch of each of the pixel circuits of the display panel comprises two first switches, one of the two first switches, the second switch, and the other of the two first switches are sequentially coupled in series, and the control terminal of one of the two first switches is coupled to the control terminal of the other of the two first switches.

According to an embodiment of the invention, a screen refresh rate of the display panel is smaller than or equal to 30 Hz.

In view of the above, the driving method for the display panel provided herein is able to effectively prevent the switch devices of the pixel circuits from staying at certain bias level for a long time and further prevent the aging effects caused by the accumulated bias stress of the switch devices.

To make the above features and advantages of the invention more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF EMBODIMENTS

The following will describe some embodiments as examples of the invention. However, it should be noted that the invention is not limited to the disclosed embodiments. Moreover, some embodiments may be combined where appropriate. The term "couple" used throughout this specification (including the claims) may refer to any direct or indirect connection means. For example, if it is described that the first device is coupled to the second device, it should be understood that the first device may be directly connected to the second device or indirectly connected to the second device through other devices or certain connection means. In addition, the term "signal" may refer to at least one current, voltage, charge, temperature, data, or one or more signals.

Figure 1:
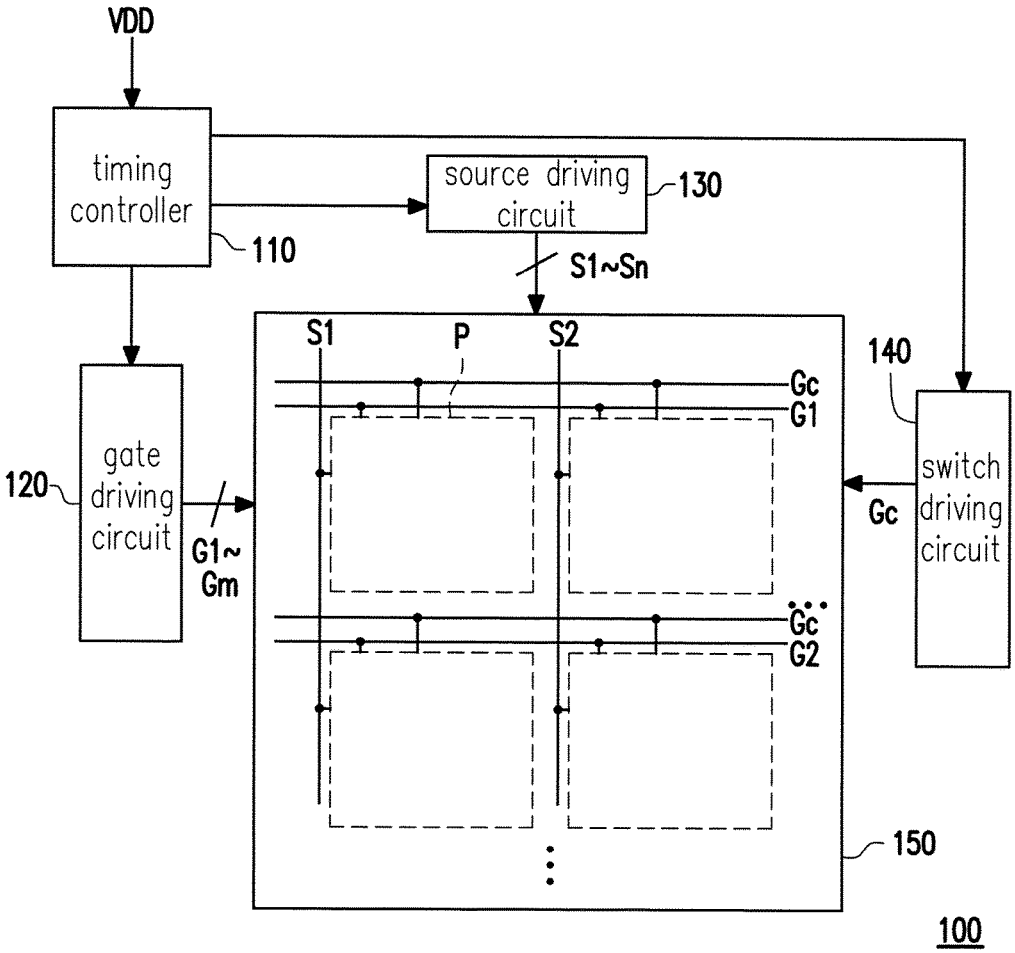
FIG. 1 is a schematic view illustrating a system of a display apparatus according to an embodiment of the invention.

FIG. 1 is a schematic view illustrating a system of a display apparatus according to an embodiment of the invention. With reference to FIG. 1, a display apparatus 100 includes a timing controller 110, a gate driving circuit 120, a source driving circuit 130, a switch driving circuit 140, and a display panel 150. The display panel 150 includes a plurality of pixel circuits P arranged in an array. Here, the display apparatus 100 may be a thin-film transistor liquid crystal display (TFT-LCD). In the present embodiment, a source signal line is arranged in each column of the pixel circuits P, and a gate signal line Gm and a common gate signal line Gc are arranged in each row of the pixel circuits P. Each switch device of the pixel circuits P may be a thin film transistor according to the present embodiment.

Here, the timing controller 110 is configured to receive an operating voltage VDD and enable the gate driving circuit 120, the source driving circuit 130, and the switch driving circuit 140. The switch driving circuit 140 outputs first driving signals to each pixel circuit P in the display panel 150 through the common gate signal lines Gc. The gate driving circuit 120 outputs a plurality of second pulse signals to each pixel circuit P in the display panel 150 through the gate signal lines G1-Gm, and m is a positive integer greater than 0. The source driving circuit 130 outputs a plurality of frame signals to each pixel circuit P in the display panel 150 through the source signal lines S1-Sn, and n is a positive integer greater than 0. In the present embodiment, the display panel 150 may be operated at a frequency with the screen refresh rate smaller than or equal to 30 Hz; however, the invention is not limited thereto.

Two ways to implement the pixel circuits in the display panel are explained hereinafter with reference to FIG. 2 and FIG. 3.

Figure 2:
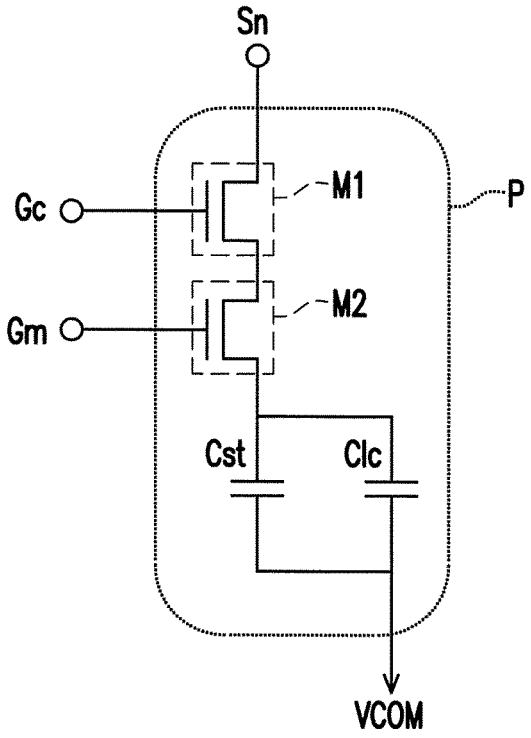
FIG. 2 is a schematic circuit diagram of a pixel circuit according to an embodiment of the invention.

FIG. 2 is a schematic circuit diagram of a pixel circuit according to an embodiment of the invention. With reference to FIG. 2, the pixel circuit P provided in the present embodiment is a dual-gate thin film transistor (TFT). The pixel circuit P includes a storage circuit Cst, a liquid crystal capacitor Clc, and a first switch M1 and a second switch M2 serially coupled to each other. The first switch M1 and the second switch M2 may be TFTs. In the present embodiment, a first terminal of the first switch M1 is coupled to the source signal line Sn. A control terminal of the first switch M1 is coupled to the common gate signal line Gc. A second terminal of the first switch M1 is coupled to a first terminal of the second switch M2. A control terminal of the second switch M2 is coupled to the gate signal line Gm. One terminal at which the storage circuit Cst and the liquid crystal capacitor Clc are serially coupled is coupled to a second terminal of the second switch M2, and the other terminal at which the storage circuit Cst and the liquid crystal capacitor Clc are serially coupled is coupled to a ground terminal VCOM. In the present embodiment, the first terminal of the first switch M1 may receive a frame signal through the source signal line Sn. The control terminal of the first switch M1 may receive the first pulse signals through the common gate signal line Gc. The control terminal of the second switch M2 may receive the second pulse signals through the gate signal line Gm.

Figure 3:
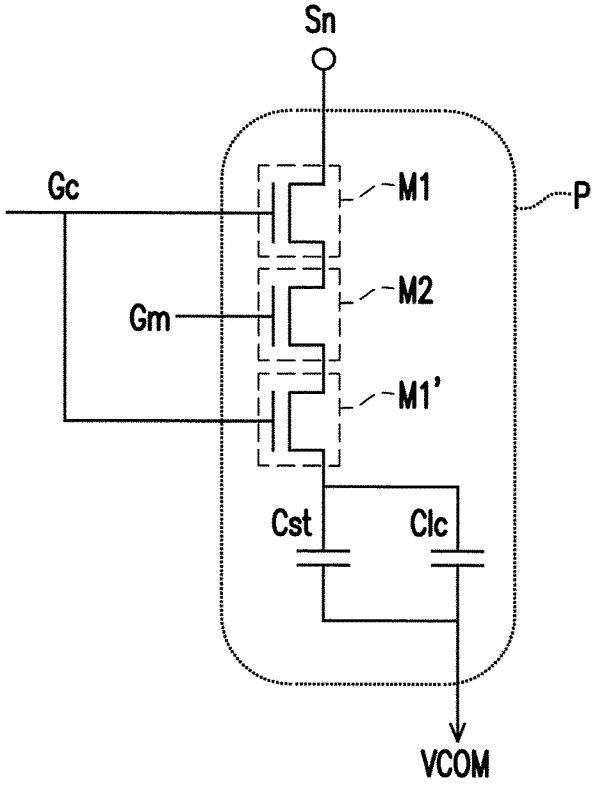
FIG. 3 is a schematic circuit diagram of a pixel circuit according to another embodiment of the invention.

FIG. 3 is a schematic circuit diagram of a pixel circuit according to another embodiment of the invention. With reference to FIG. 3, the pixel circuit P provided in the present embodiment is a triple-gate TFT. The pixel circuit P includes a storage circuit Cst, a liquid crystal capacitor Clc, two first switches M1 and M1' serially coupled to each other, and a second switch M2. The first switches M1 and M1' and the second switch M2 may be TFTs. Besides, compared to the pixel circuit with two serially coupled switch devices, the pixel circuit with three serially coupled switch devices as described in the present embodiment may contribute to the reduction of current leakage.

In the present embodiment, a first terminal of the first switch M1 is coupled to the source signal line Sn. A control terminal of the first switch M1 is coupled to the common gate signal line Gc. A second terminal of the first switch M1 is coupled to a first terminal of the second switch M2. A control terminal of the second switch M2 is coupled to the gate signal line Gm. A second terminal of the second switch M2 is coupled to the other first switch M1'. A control terminal of the other first switch M1' is also coupled to the common gate signal line Gc. One terminal at which the storage circuit Cst and the liquid crystal capacitor Clc are serially coupled is coupled to a second terminal of the other first switch M1', and the other terminal at which the storage circuit Cst and the liquid crystal capacitor Clc are serially coupled is coupled to a ground terminal VCOM. In the present embodiment, the first terminal of the first switch M1 may receive a frame signal through the source signal line Sn. The control terminals of the first switches M1 and M1' may receive the first pulse signals through the common gate signal line Gc, respectively. The control terminal of the second switch M2 may receive the second pulse signals through the gate signal line Gm.

FIG. 4 to FIG. 10 respectively exemplify the ways to implement the timing-control methods of the display panel in a de-stress mode, and the implementations illustrated in FIG. 4 to FIG. 10 may be applied to the pixel circuits depicted in FIG. 2 and FIG. 3; however, the invention is not limited thereto.

Figure 4:
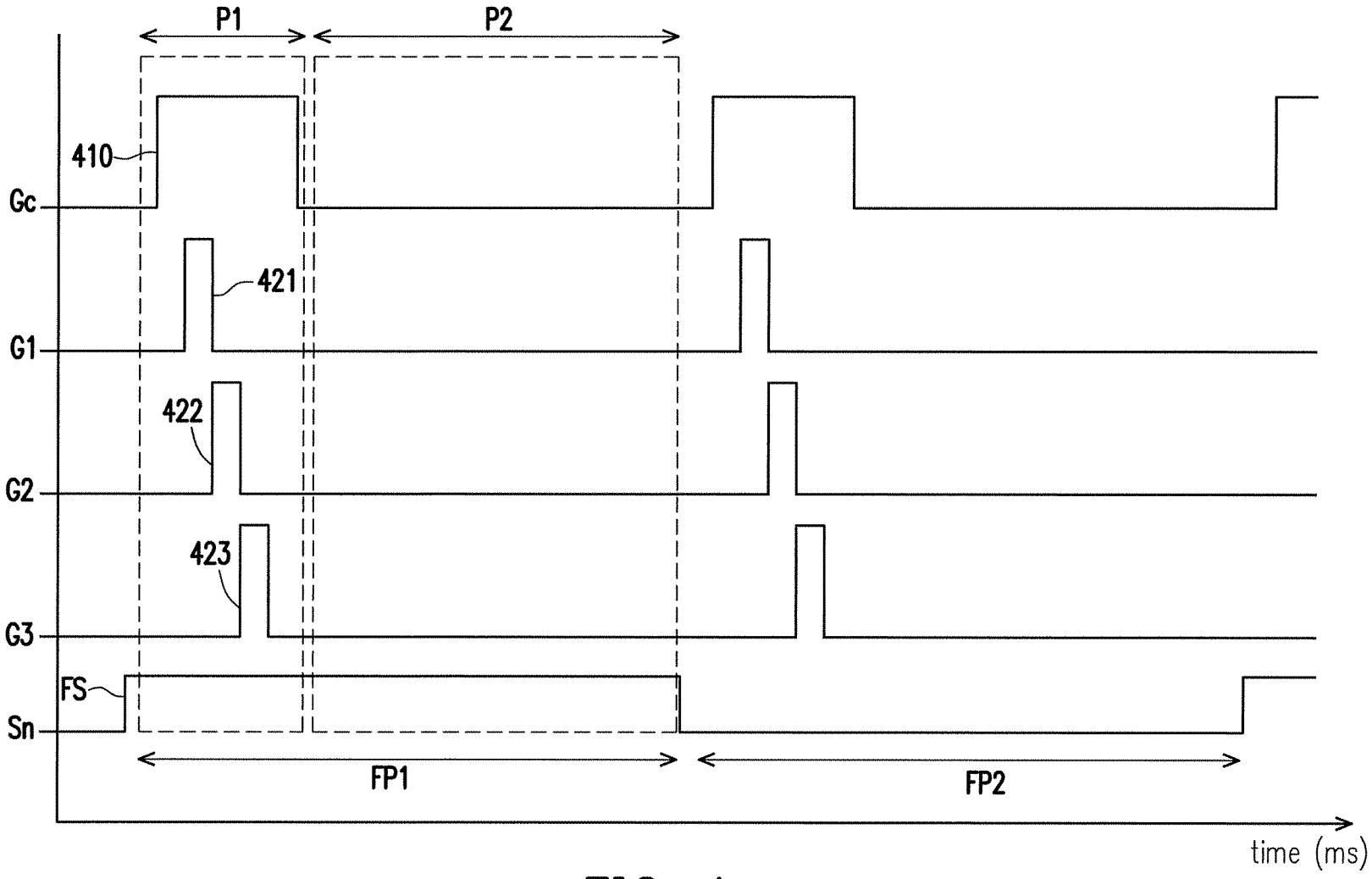
FIG. 4 illustrates signal waveforms in a normal mode according to an embodiment of the invention.

FIG. 4 illustrates signal waveforms in a normal mode according to an embodiment of the invention. With reference to FIG. 1, FIG. 3, and FIG. 4, the signal waveforms shown in FIG. 4 are applicable to the display panel 150 shown in FIG. 1 and may be applicable to the pixel circuit P shown in FIG. 3, for instance. In the present embodiment, the pixel circuits P in each column of the display panel 150 may receive a frame signal FS through the source signal line Sn. Note that the signal waveforms are described on the condition that the pixel circuits P in three rows are provided, while the number of columns and rows in which the pixel circuits P are arranged is not limited in the present embodiment. Besides, the pixel circuits P provided in the present embodiment may be operated during a frame-writing period FP1 and a non-frame-writing period FP2.

During the update period P1, the control terminals of the first switches M1 and M1' of each pixel circuit P of the display panel 150 may receive the first driving signal 410 through the common gate signal line Gc, such that the first switches M1 and M1' of each pixel circuit P are continuously turned on during the update period P1. Besides, the control terminals of the second switches M2 of the pixel circuits P in each row may sequentially receive a plurality of second pulse signals 421, 422, and 423 through the gate signal lines G1, G2, and G3. Namely, in the update period P1, each pixel circuit P of the display panel 150 may perform the writing operation of the frame signal FS by sequentially receiving the driving signal through its second switch M2. During the waiting period P2, no signal is received by the control terminals of the first switches M1 and M1' and the second switches M2 of the pixel circuits P of the display panel 150. Additionally, during the non-frame-writing period FP2, the display panel 150 may receive the same pulse signal waveforms as those received in the frame-writing period FP1, which should however not be construed as a limitation to the invention.

Figure 5:
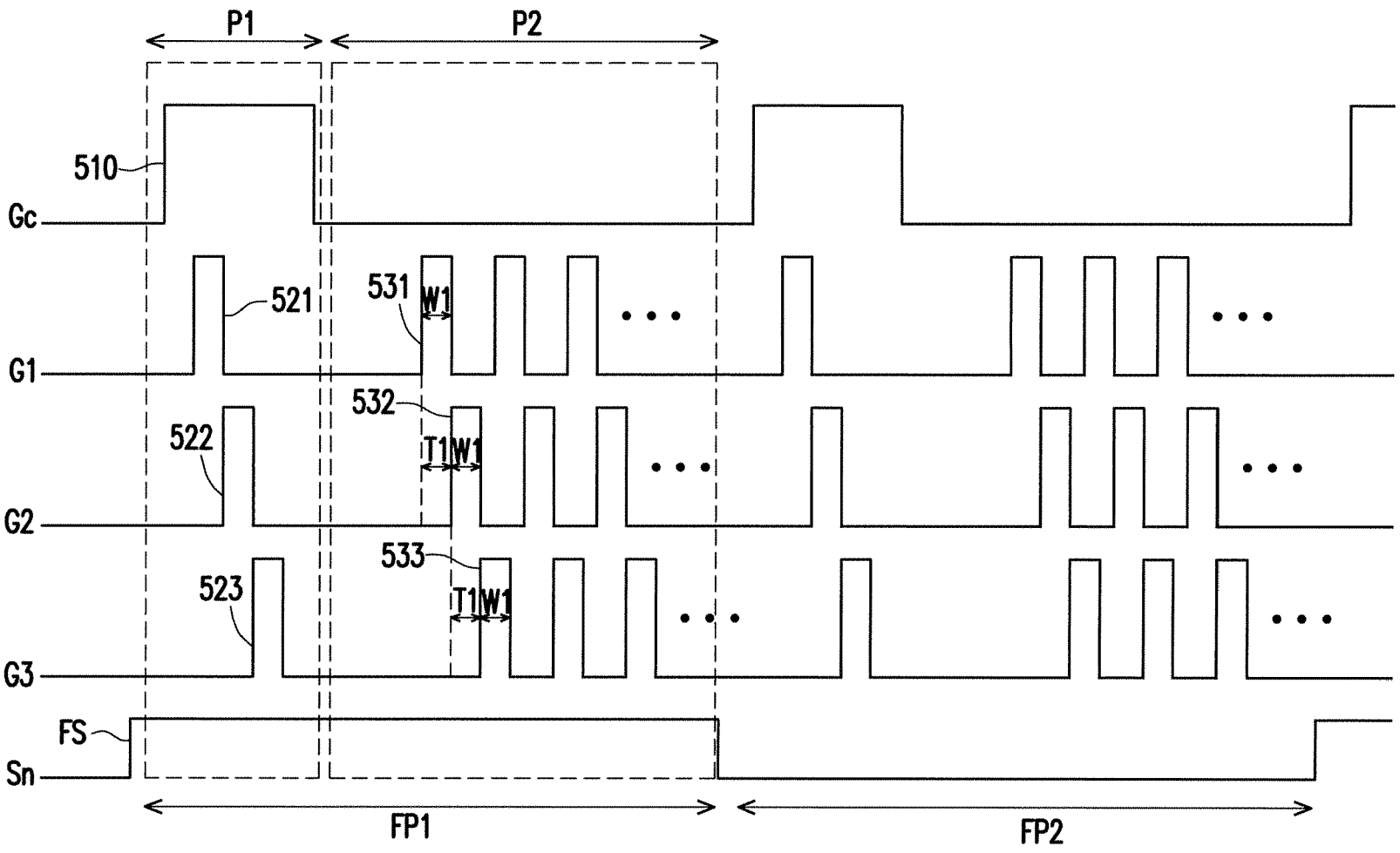
FIG. 5 illustrates signal waveforms in a first de-stress mode according to an embodiment of the invention.

FIG. 5 illustrates signal waveforms in a first de-stress mode according to an embodiment of the invention. With reference to FIG. 1, FIG. 3, and FIG. 5, the first switches M1 and M1' of each pixel circuit P of the display panel 150 may receive the first driving signal 510 through the common gate signal line Gc during the update period P1, and the second switches M2 of the pixel circuits P in each row sequentially receive the second driving signals 521, 522, and 523.

Compared to the previous embodiment, the present embodiment discloses that the control terminals of the second switches M2 of the pixel circuits P in each row of the display panel 150 sequentially and periodically receive the first pulse signals 531, 532, and 533 during the waiting period P2. For instance, the pulse width W1 of the first pulse signals 531, 532, and 533 may be 0.5 ms, for instance, and the time interval T1 among the first pulse signals 531, 532, and 533 is 1.5 ms, for instance. However, the invention is not limited thereto. Additionally, during the non-frame-writing period FP2, the display panel 150 may receive the same driving signal waveform and the same pulse signal waveforms as those received in the frame-writing period FP1, which should however not be construed as a limitation to the invention.

Figure 6:
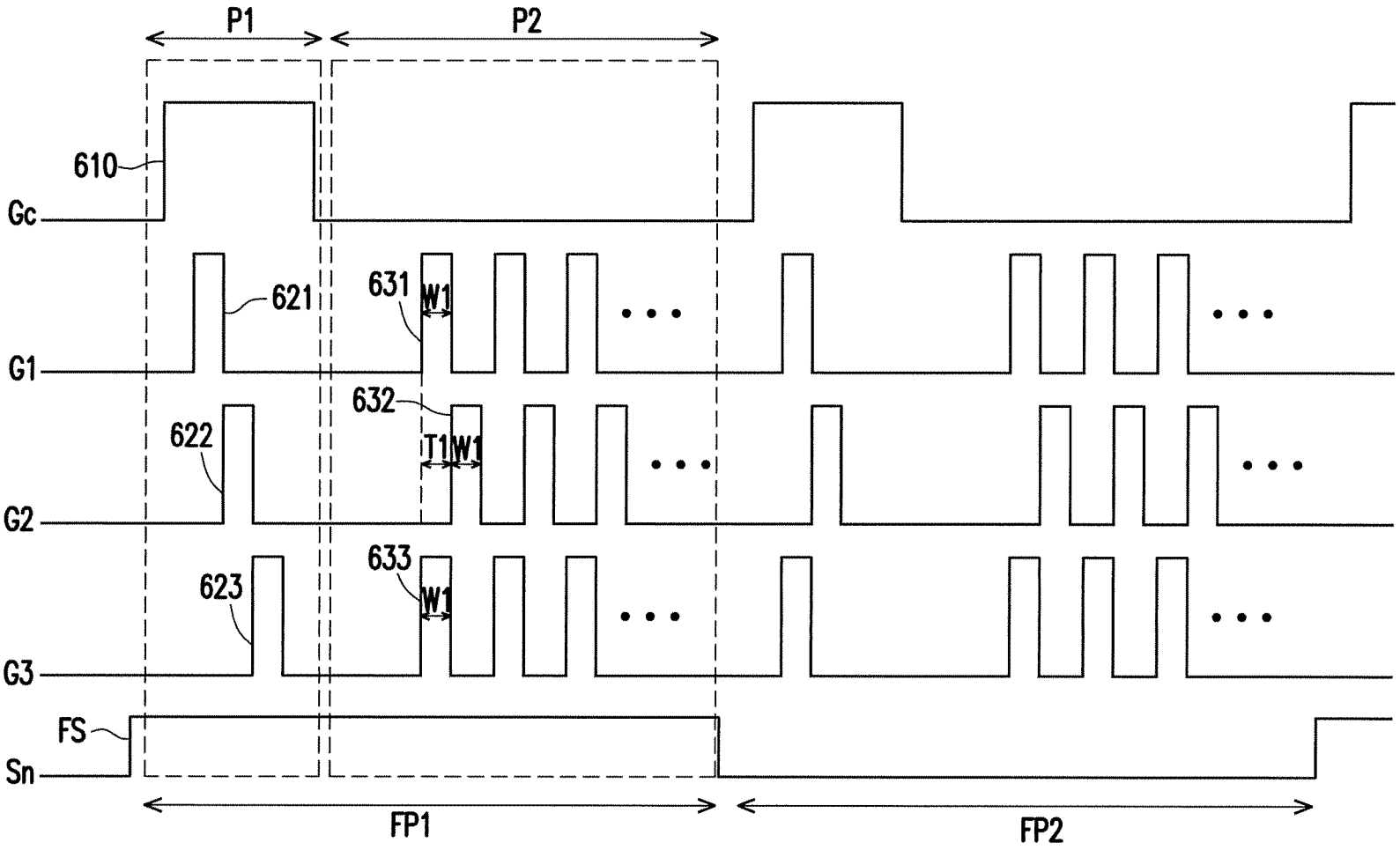
FIG. 6 illustrates signal waveforms in a first de-stress mode according to another embodiment of the invention.

FIG. 6 illustrates signal waveforms in a first de-stress mode according to another embodiment of the invention. With reference to FIG. 1, FIG. 3, and FIG. 6, the first switches M1 and M1' of each pixel circuit P of the display panel 150 may receive the first driving signal 610 through the common gate signal line Gc during the update period P1, and the second switches M2 of the pixel circuits P in each row sequentially receive the second driving signals 621, 622, and 623.

Compared to the previous embodiment, the present embodiment discloses that the control terminals of the second switches M2 of the pixel circuits P in odd rows and in even rows of the display panel 150 alternately and periodically receive the first pulse signals 631, 632, and 633 respectively at the time interval T1 during the waiting period P2. For instance, the pulse width W1 of the first pulse signals 631, 632, and 633 may be 0.5 ms, for instance, and the time interval among the first pulse signals 531, 532, and 533 is 1.5 ms, for instance. Additionally, during the non-frame-writing period FP2, the display panel 150 may receive the same driving signal waveform and the same pulse signal waveforms as those received in the frame-writing period FP1, which should however not be construed as a limitation to the invention.

Figure 7:
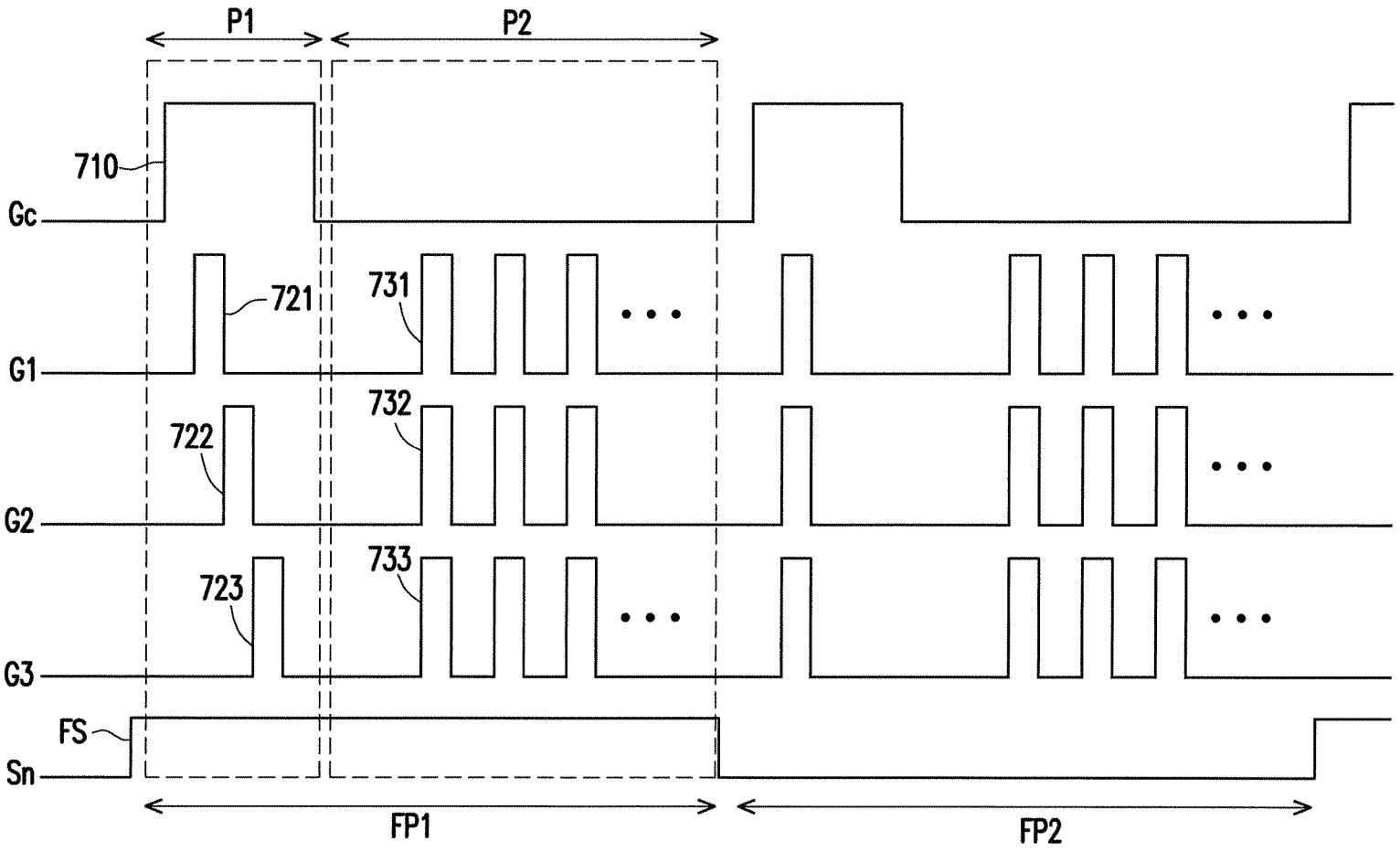
FIG. 7 illustrates signal waveforms in a first de-stress mode according to still another embodiment of the invention.

FIG. 7 illustrates signal waveforms in a first de-stress mode according to still another embodiment of the invention. With reference to FIG. 1, FIG. 3, and FIG. 7, the first switches M1 and M1' of each pixel circuit P of the display panel 150 may receive the first driving signal 710 through the common gate signal line Gc during the update period P1, and the second switches M2 of the pixel circuits P in each row sequentially receive the second driving signals 721, 722, and 723.

Compared to the previous embodiment, the present embodiment discloses that the control terminals of the second switches M2 of the pixel circuits P in odd rows and in even rows of the display panel 150 simultaneously and periodically receive the first pulse signals 731, 732, and 733 during the waiting period P2. Additionally, during the non-frame-writing period FP2, the display panel 150 may receive the same driving signal waveform and the same pulse signal waveforms as those received in the frame-writing period FP1, which should however not be construed as a limitation to the invention.

Figure 8:
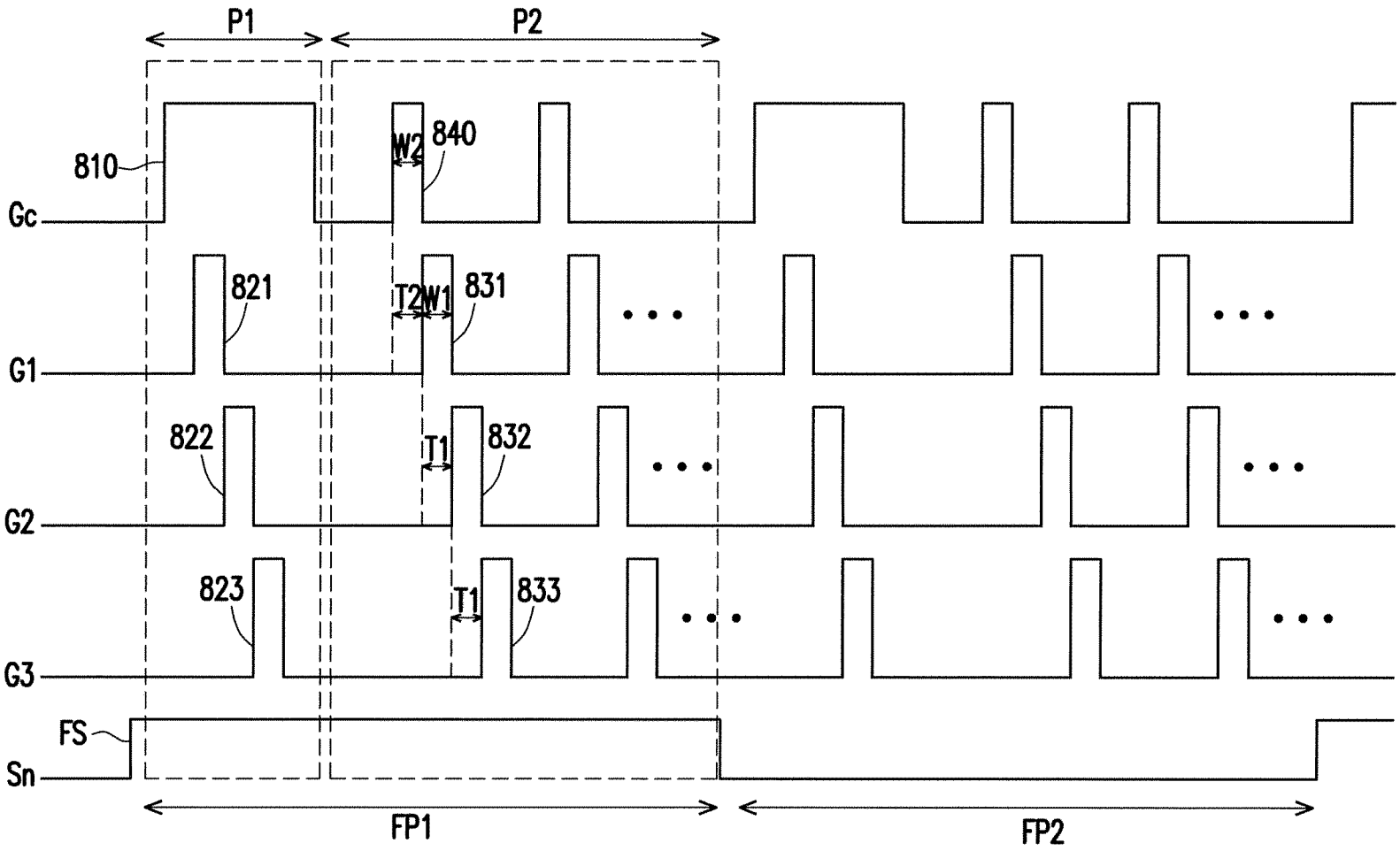
FIG. 8 illustrates signal waveforms in a second de-stress mode according to an embodiment of the invention.

FIG. 8 illustrates signal waveforms in a second de-stress mode according to an embodiment of the invention. With reference to FIG. 1, FIG. 3, and FIG. 8, the first switches M1 and M1' of each pixel circuit P of the display panel 150 may receive the first driving signal 810 through the common gate signal line Gc during the update period P1, and the second switches M2 of the pixel circuits P in each row sequentially receive the second driving signals 821, 822, and 823.

Compared to the previous embodiment, the present embodiment discloses that the control terminals of the second switches M2 of the pixel circuits P in each row of the display panel 150 sequentially and periodically receive the first pulse signals 831, 832, and 833 during the waiting period P2. For instance, the pulse width W1 of the first pulse signals 831, 832, and 833 may be 0.5 ms, for instance, and the time interval T1 among the first pulse signals 831, 832, and 833 is 1.5 ms, for instance. However, the invention is not limited thereto.

Compared to the previous embodiment, the present embodiment discloses that the first switches M1 and M1' of each of the pixel circuits P of the display panel 150 periodically receive the second pulse signals 840 during the waiting period P2. The pulse width W2 of the second pulse signals 840 may be the same as or different from the pulse width W1, for instance, and the time interval T2 may exist between the second pulse signals 840 and the first pulse signal 831, for instance; however, the invention is not limited thereto. Additionally, during the non-frame-writing period FP2, the display panel 150 may receive the same driving signal waveform and the same pulse signal waveforms as those received in the frame-writing period FP1, which should however not be construed as a limitation to the invention.

Figure 9:
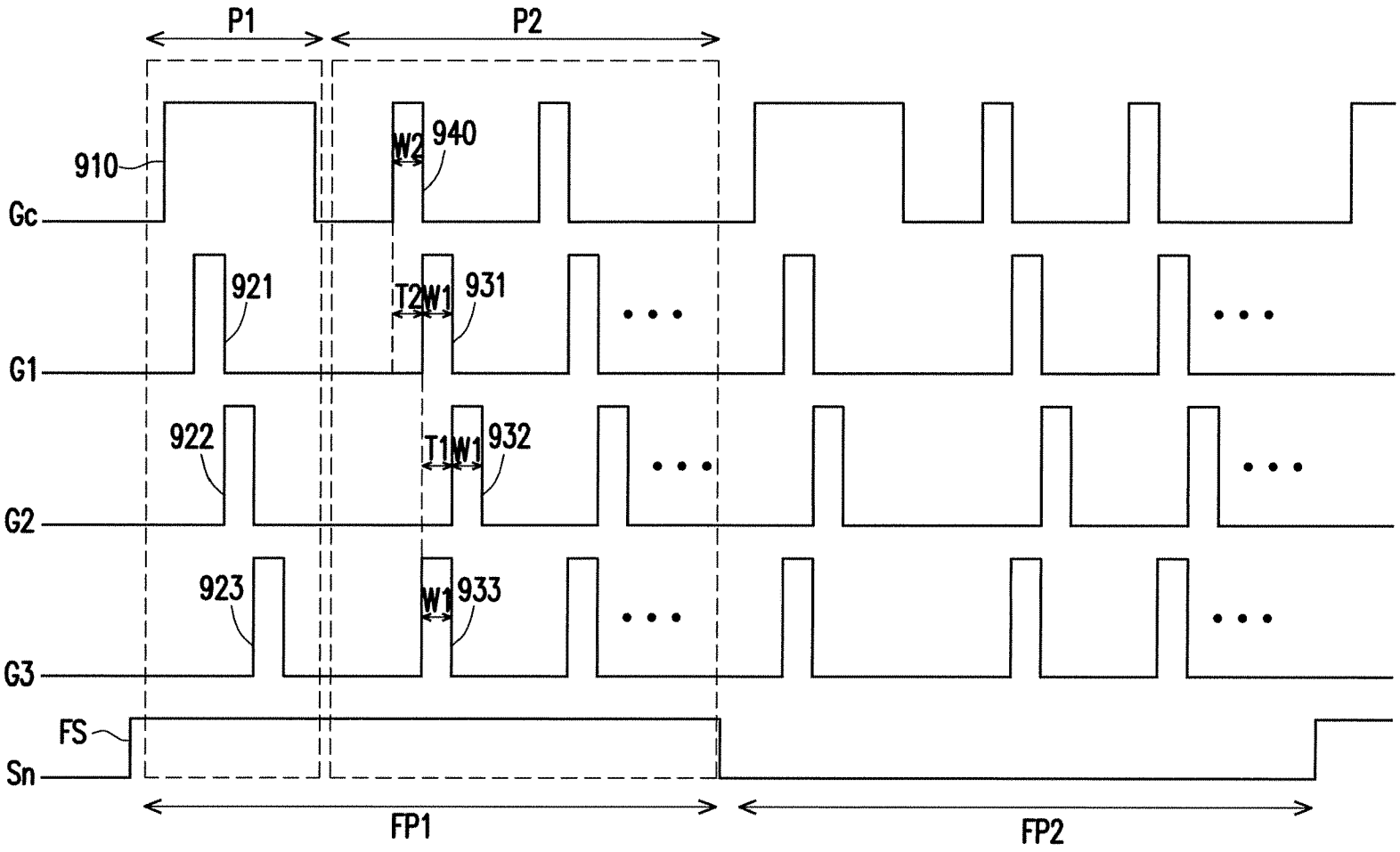
FIG. 9 illustrates signal waveforms in a second de-stress mode according to another embodiment of the invention.

FIG. 9 illustrates signal waveforms in a second de-stress mode according to another embodiment of the invention. With reference to FIG. 1, FIG. 3, and FIG. 9, the first switches M1 and M1' of each pixel circuit P of the display panel 150 may receive the first driving signal 910 through the common gate signal line Gc during the update period P1, and the second switches M2 of the pixel circuits P in each row sequentially receive the second driving signals 921, 922, and 923.

Compared to the previous embodiment, the present embodiment discloses that the control terminals of the second switches M2 of the pixel circuits P in odd rows and in even rows of the display panel 150 alternately and periodically receive the first pulse signals 931, 932, and 933 respectively at the time interval T1 during the waiting period P2. For instance, the pulse width W1 of the first pulse signals 931, 932, and 933 may be 0.5 ms, for instance, and the time interval T1 among the first pulse signals 931, 932, and 933 is 1.5 ms, for instance. However, the invention is not limited thereto.

Compared to the previous embodiment, the present embodiment discloses that the first switches M1 and M1' of each of the pixel circuits P of the display panel 150 periodically receive the second pulse signals 940 during the waiting period P2. The pulse width W2 of the second pulse signals 940 may be the same as or different from the pulse width W1, for instance, and the time interval T2 may exist between the second pulse signals 940 and the first pulse signal 931, for instance; however, the invention is not limited thereto. Additionally, during the non-frame-writing period FP2, the display panel 150 may receive the same driving signal waveform and the same pulse signal waveforms as those received in the frame-writing period FP1, which should however not be construed as a limitation to the invention.

Figure 10:
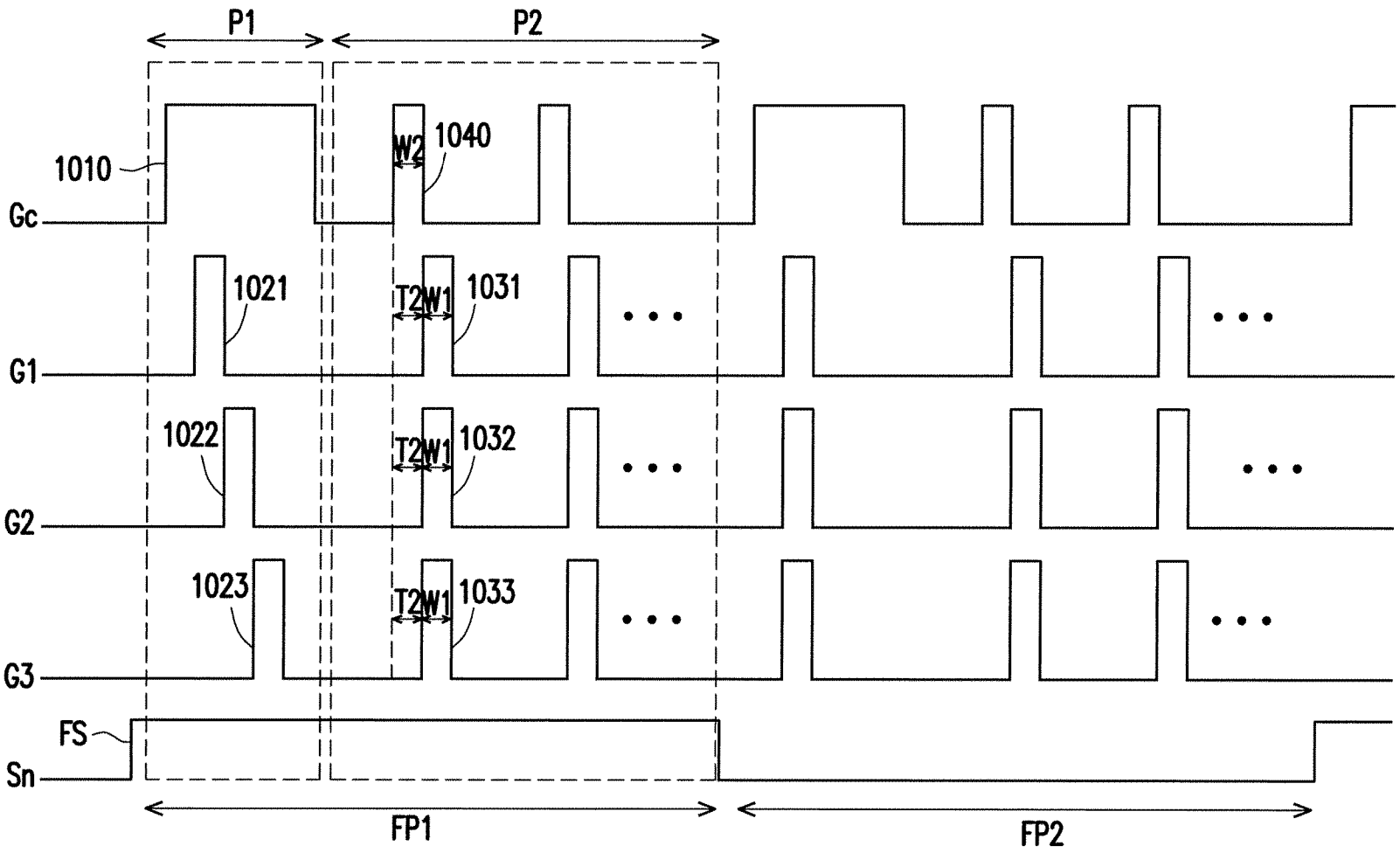
FIG. 10 illustrates signal waveforms in a second de-stress mode according to still another embodiment of the invention.

FIG. 10 illustrates signal waveforms in a second de-stress mode according to still another embodiment of the invention. With reference to FIG. 1, FIG. 3, and FIG. 10, the first switches M1 and M1' of each pixel circuit P of the display panel 150 may receive the first driving signal 1010 through the common gate signal line Gc during the update period P1, and the second switches M2 of the pixel circuits P in each row sequentially receive the second driving signals 1021, 1022, and 1023.

Compared to the previous embodiment, the present embodiment discloses that the control terminals of the second switches M2 of the pixel circuits P in odd rows and in even rows of the display panel 150 simultaneously and periodically receive the first pulse signals 1031, 1032, and 1033 during the waiting period P2. For instance, the pulse width W1 of the first pulse signals 1031, 1032, and 1033 may be 0.5 ms, for instance.

Compared to the previous embodiment, the present embodiment discloses that the first switches M1 and M1' of each of the pixel circuits P of the display panel 150 periodically receive the second pulse signals 1040 during the waiting period P2. The pulse width W2 of the second pulse signals 1040 may be the same as or different from the pulse width W1, for instance, and the time interval T2 may exist between the second pulse signals 1040 and the first pulse signal 1031, for instance; however, the invention is not limited thereto. Additionally, in the present embodiment, during the non-frame-writing period FP2, the display panel 150 may receive the same driving signal waveform and the same pulse signal waveforms as those received in the frame-writing period FP1, which should however not be construed as a limitation to the invention.

The pixel circuit P shown in FIG. 3 is taken for example. The timing-control methods of the display panel in each mode as illustrated in FIG. 4 to FIG. 10 may be applied to effectively prevent the first switches M1 and M1' and the second switch M2 from staying at a certain bias level for a long time, and the aging effects of the TFT caused by the bias stress may be further restrained.

The first pulse signals provided in the above embodiments have a first high-level voltage and a first low-level voltage, and the second pulse signals have a second high-level voltage and a second low-level voltage. In an embodiment, the pixel circuit may further include a multiplexer or other circuit devices, and the high-level voltages and the low-level voltages of the pulse signals may be adjusted according to not only the pulse signal waveforms shown in FIG. 4 to FIG. 10 but also the specifications of the panel, the user's requirements, or other conditions.

Figure 11:
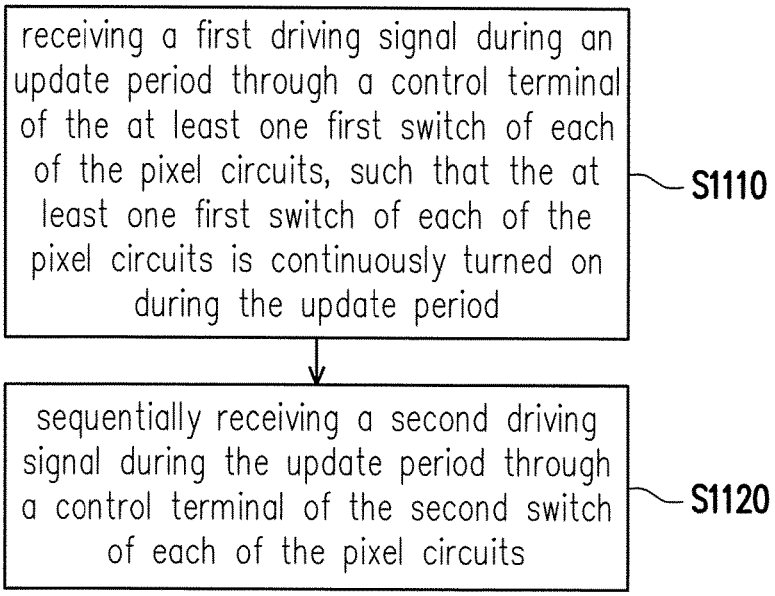
FIG. 11 is a flow chart of a driving method for a display panel according to an embodiment of the invention.

FIG. 11 is a flow chart of a driving method for a display panel according to an embodiment of the invention. The driving method provided herein is at least applicable to the display panel 150 shown in FIG. 1 and the pixel circuits P shown in FIG. 2 and FIG. 3. With reference to FIG. 1 and FIG. 11, in the present embodiment, the display panel 150 has a plurality of pixel circuits P arranged in an array, and each of the pixel circuits P includes at least one first switch and a second switch coupled in series. The driving method provided in the present embodiment includes following steps. In step S1110, the display panel 150 receives a first driving signal during an update period through a control terminal of the at least one first switch of each of the pixel circuits, such that the at least one first switch of each of the pixel circuits is continuously turned on during the update period. In step S1120, the display panel 150 sequentially receives a second driving signal during the update period through a control terminal of the second switch of each of the pixel circuits.

Other ways to implement the driving method of the display panel can be understood sufficiently from the teaching, suggestion, and descriptions of the embodiments illustrated in FIG. 1 to FIG. 10. Thus, details thereof are not repeated hereinafter.

To sum up, the driving method for the display panel is capable of effectively restraining the aging effects of the switch devices in each pixel circuit when the display panel is being operated in a low-frequency mode (e.g., the operating frequency is equal to or less than 30 Hz). That is, each pixel circuit of the display panel may periodically provide the pulse signals to the switch devices during the waiting period, so as to effectively prevent the switch devices from staying at a certain bias level for a long time and further restrain the aging effects of the TFT caused by the bias stress.

It will be apparent to those skilled in the art that various modifications and variations can be made to the disclosed embodiments without departing from the scope or spirit of the invention. In view of the foregoing, it should be mentioned that the invention covers modifications and variations of this disclosure provided that they fall within the scope of the following claims and their equivalents.

What is claimed is:

1. A driving method for a display panel having a plurality of pixel circuits arranged in an array, each of the pixel circuits comprises at least one first switch and a second switch coupled in series, and comprises a storage capacitor and a liquid crystal capacitor respectively coupled to the at least one first switch and a second switch in series, the driving method comprising:

receiving a first driving signal during an update period through a control terminal of the at least one first switch of each of the pixel circuits, such that the at least one first switch of each of the pixel circuits is continuously turned on during the update period; and sequentially receiving a second driving signal during the update period through a control terminal of the second switch of each of the pixel circuits, wherein during the update period, a turn-on period of the at least one first switch of each of the pixel circuits is greater than and partially overlaps a turn-on period of the second switch of each of the pixel circuits, wherein during the update period, the each of the pixel circuits charges the storage capacitor and the liquid crystal capacitor through a source signal line when the at least one first switch and the second switch of each of the pixel circuits are simultaneously turned on.

2. The driving method of claim 1, further comprising:

periodically receiving a plurality of first pulse signals during a waiting period through the control terminal of the second switch of each of the pixel circuits, wherein the first pulse signals have a first pulse width, and the first pulse signals have a first high-level voltage and a first low-level voltage.

3. The driving method of claim 2, wherein the step of periodically receiving the first pulse signals during the waiting period through the control terminal of the second switch of each of the pixel circuits comprises:

adjusting at least one of the first high-level voltage and the first low-level voltage of the first pulse signals.

4. The driving method of claim 2, wherein a first time interval exists between the control terminal of the second switch of each of the pixel circuits during the waiting period, so as to sequentially receive the first pulse signals.

5. The driving method of claim 2, wherein a first time interval exists between the control terminal of the second switch of each of the pixel circuits in odd rows and the control tee urinal of the second switch of each of the pixel circuits in even rows, so as to alternately receive the second pulse signals.

6. The driving method of claim 2, wherein the control terminal of the second switch of each of the pixel circuits simultaneously receives the first pulse signals during the waiting period.

7. The driving method of claim 2, further comprising:

receiving a plurality of second pulse signals during the waiting period by the control terminal of the at least one first switch of each of the pixel circuits, the second pulse signals having a second pulse width, wherein the pixel circuits receive the second pulse signals and the first pulse signals at different times, and a second time interval exists between the time at which the first pulse signals are received by the pixel circuits and the time at which the second pulse signals are received by at least one of the pixel circuits.

8. The driving method of claim 7, wherein the second pulse signals have a second high-level voltage and a second low-level voltage, and the step of receiving the second pulse signals during the waiting period through the control terminal of the at least one first switch of each of the pixel circuits further comprises:

adjusting at least one of the second high-level voltage and the second low-level voltage of the second pulse signals.

9. The driving method of claim 1, wherein the at least one first switch of each of the pixel circuits of the display panel comprises two first switches, one of the two first switches, the second switch, and the other of the two first switches are sequentially coupled in series, and the control terminal of one of the two first switches is coupled to the control terminal of the other of the two first switches.

10. The driving method of claim 1, wherein a screen refresh rate of the display panel is smaller than or equal to 30 Hz.

* * * * *